United States Patent [19]

Aluisi

[11] Patent Number: 4,519,288

[45] Date of Patent: May 28, 1985

[54] DRUM BAFFLE SYSTEM

[76] Inventor: Alan L. Aluisi, 4359 Batavia, Denver, Colo. 80220

[21] Appl. No.: 600,327

[22] Filed: Apr. 13, 1984

[51] Int. Cl.[3] ..... G10D 13/02

[52] U.S. Cl. ..... 84/411 M

[58] Field of Search ..... 84/411–421

[56] References Cited

U.S. PATENT DOCUMENTS

| | | | |
|---|---|---|---|
| 2,572,504 | 10/1951 | Meriwether | 84/411 M |
| 3,951,032 | 4/1976 | La Porta | 84/419 |
| 4,325,280 | 4/1982 | Hardy | 84/411 M |
| 4,338,850 | 7/1982 | Payson | 84/411 M |

*Primary Examiner*—Lawrence R. Franklin
*Attorney, Agent, or Firm*—Klaas & Law

[57] ABSTRACT

A baffling system for altering the sound produced by a drum of the type having a tubular drum shell with a central longitudinal drum axis and at least one batter head attached at one end of the drum shell including: a first set of baffles for dampening vibrations in the drum batter head mounted in fixed relationship with the inner wall of the drum shell and contracting an inner peripheral surface portion of the drum batter head; second set of baffles for deepening the drum tone positioned in radially inwardly spaced relationship from the drum shell inner wall and spaced radially outwardly from the drum central longitudinal axis in contacting relationship with an inner surface of the drum batter head; and a floating baffle suspension for resiliently biasing said second set of baffles against the batter head inner surface and for maintaining said second set of baffles in radially fixed axially displaceable relationship relative said drum shell whereby said second set of baffles makes substantially continuous contact with said drum head during vibrating and non-vibrating states of said drum head.

18 Claims, 8 Drawing Figures

FIG. 2
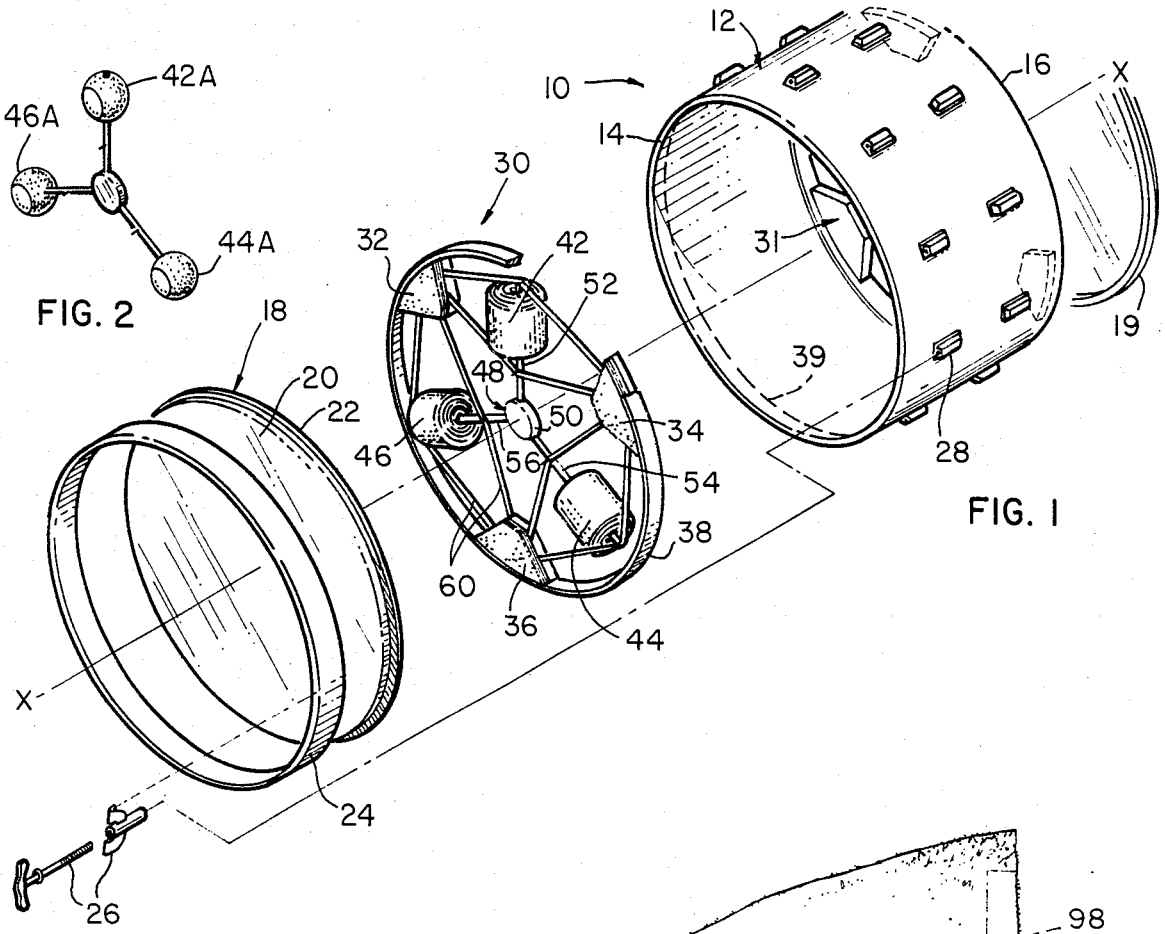
FIG. 1
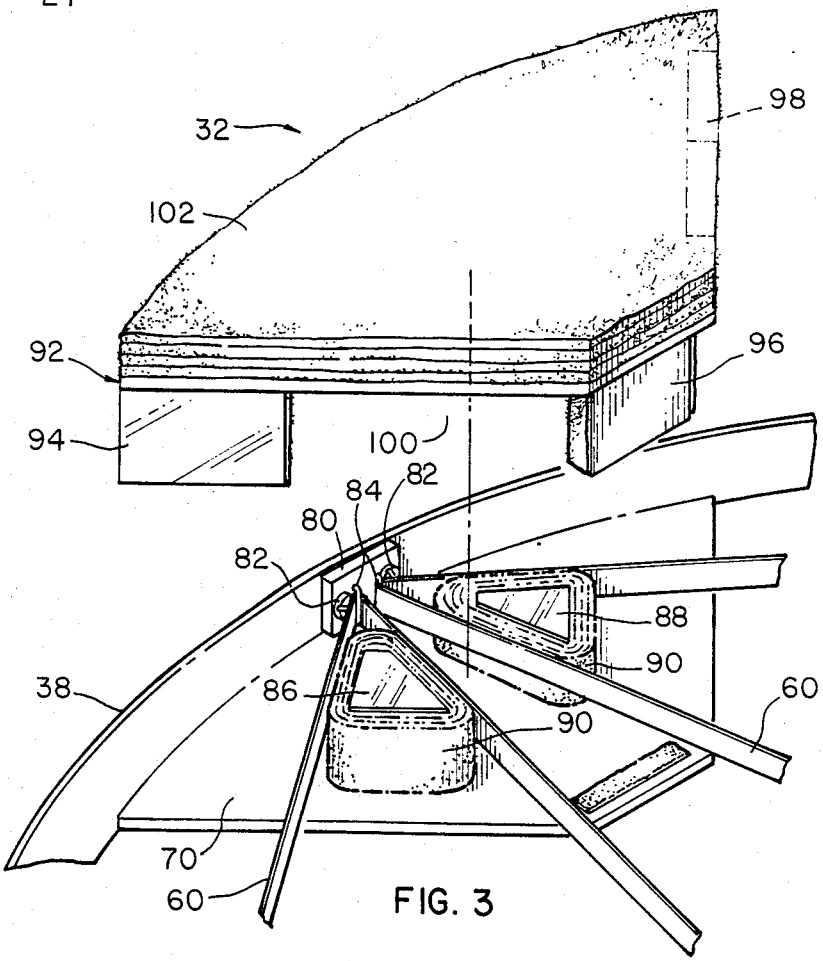
FIG. 3

DRUM BAFFLE SYSTEM

BACKGROUND OF THE INVENTION

The present invention relates generally to sound altering apparatus used on drums and more particularly to an apparatus for dampening drum vibrations while simultaneously deepening drum tones.

A wide number of apparatus have been used for the purpose of altering the sound produced by a drum. For the most part, these apparatus are associated with the batter head of a drum and alter the length and quality of the drum tone by changing the vibration characteristics of the drum batter head.

One type of device known as a muffler is used to substantially limit the amplitude of vibration produced in the drum head so that drum may be used for practicing without producing a great amount of sound. One such device is described in Lebow U.S. Pat. No. 2,078,004 which describes a batter pad member formed of rubber and reinforced by metal band around its periphery and attached to a rigid base plate. Hanger arms are hinged to the anchoring plate and are providing with bent fingers upon which are mounted resilient pads with sleeves which in turn fit over the rim of the shell of the drum. The batter pad member is positioned at the center of the drum and provides a muffling effect on the drum head during practice.

Another muffler for a percussion instrument is illustrated in Payson U.S. Pat. No. 4,338,850. This muffler includes a supple material which is situated contiguous to the head of the drum, one or more elastic strips to maintain the supple material in contiguous relationship of the drum head, and a cord situated to selectively withdraw successive portions of the supple material from contiguous relationship to the drum head in order to alter the degree of muffling produced. The supple material may be felt, fir, or other soft flexible material. The supple material lies adjacent only a portion of the drum head bounded by a cord. The cord is attached to the top of the supple material and is located so that as the cord is tensioned successive portions of the supple material are selectively withdrawn from contiguous relationship to the drum head.

A device for reducing drum head ring is described by Hardy, U.S. Pat. No. 4,325,281 which discloses a body of porous pliable material such as polyester foam which is disposed within the drum shell and reacts with the drum membrane or batter head. An adhesive layer is disposed on the body for attaching the body to the drum shell. The body may be of a single segment or a plurality of segments each in contact with the membrane and disposed adjacent to each other around the inner surface of the drum shell.

Hardy U.S. Pat. No. 4,325,280 discloses a device for deadening drum heads to reduce the ringing phenomena associated with synthetic membranes in which a plurality of bodies of porous pliable material are disposed around the preferred attack area of the drum membrane. Each of the bodies has an adhesive layer on one surface and the adhesive layer is used to attach the body to the drum head membrane. The bodies may be circular, square, or rectangular.

Hardy U.S. Pat. No. 4,244,266 describes a drum head deadening devise in which a body of porous pliable material has an adhesive layer on one surface and the adhesive layer is used to attach the body to a drum head membrane. An opening is disposed in the body to correspond to an attack area of the drum membrane.

LaPorta, et al., U.S. Pat. No. 3,951,032 describes a timpani drum which uses a remote push-pull control cable to control a dampening plate. The dampening plate is contained in a sleeve that is secured to the shell of the drum by brackets. The bracket may be varied in length which permits alteration of the degree to which the bracket extends to the center of the drum from the shell wall. The dampening plate may be urged against the underside of the drum membrane to terminate its vibration or to mute a blow to the membrane. The associated cable mechanism may be operated by foot.

Meriwether U.S. Pat. No. 2,572,504 discloses a lever actuated drum tone modulator which includes a lever pivotally mounted on a bracket with modulating pads mounted in another bracket with stems on the outer ends on which the pads are carried. The pads are slidably in the bracket and are biased inwardly by springs. Powered movement of the lever draws a cam between the stems thereby forcing modulating pads outwardly and into engagement with opposite drum heads. When it is desired to release the drum heads, the actuating lever is moved inwardly whereby the springs draw the pads away from the drum heads.

The particular type of apparatus which is associated with a drum batter head or with a drum shell may affect the sound produced by the drum in a number of ways. It may lower the amplitude of the sound produced. It may tend to dampen the vibrations of either the drum head or the drum shell. It may tend to increase or decrease the frequency of the tones produced in the drum head. It may tend to increase or decrease certain types of overtones in the drum sound. Generally it will provide a combination of these and other effects.

It is generally desirable in studio type work to produce a rich deep drum tone sound with a limited amount of ringing and other secondary relatively long duration affects. However, drum muffling devices used in the past which have been effective to reduce ringing and the like have also tended to deaden the tone produced by the drum.

It is an object of the present invention to provide a drum muffling device which eliminates ringing and other undesirable attenuation effects and which simultaneously provides a deep fully developed drum tone.

It is also among the objects of the present invention to provide a drum muffling device which may be used with a single batter head or with double batter heads.

It is also among the objects of the invention to provide a drum muffling device which may be quickly inserted or removed from a drum head as a modular unit.

It is also among the objects of the invention to provide a drum head muffling device which may be integrally built with a drum.

It is also among the objects of the invention to provide a drum head muffling device which utilizes a floating suspension system to provide relatively continuous momentum transferring contact between the drum head and a muffling device without limiting the range of vibrational movement of the drum head and without unnecessarily interrupting the free span of the drum head with fixed structure.

SUMMARY OF THE INVENTION

The present invention includes a baffling system for altering the sound produced by a drum of the type having a tubular drum shell with a central longitudinal drum axis and at least one batter head attached at one end of the drum shell comprising: first baffle means for dampening vibrations in the drum batter head mounted in fixed relationship with the inner wall of the drum shell and contacting an inner peripheral surface portion of the drum batter head; second baffle means for deepening the drum tone positioned in radially inwardly spaced relationship from the drum shell inner wall and spaced radially outwardly from the drum central longitudinal axis in contacting relationship with an inner surface of the drum batter head; and second baffle suspension means for resiliently biasing said second baffle means against the batter head inner surface and for maintaining said second baffle means in radially fixed axially displaceable relationship relative said drum shell whereby said second baffle means makes substantially continuous contact with said drum head during vibrating and non-vibrating states of said drum head.

BRIEF DESCRIPTION OF THE DRAWING

An illustrative and presently preferred embodiment of the invention is shown in the accompanying drawing in which:

FIG. 1 is an exploded perspective view of a drum equipped with a drum baffling assembly.

FIG. 2 is a perspective view of a floating baffle subassembly.

FIG. 3 is a detailed exploded perspective view of a fixed baffle and a portion of a floating baffle suspension system.

DETAILED DESCRIPTION OF THE INVENTION

Figure 4:
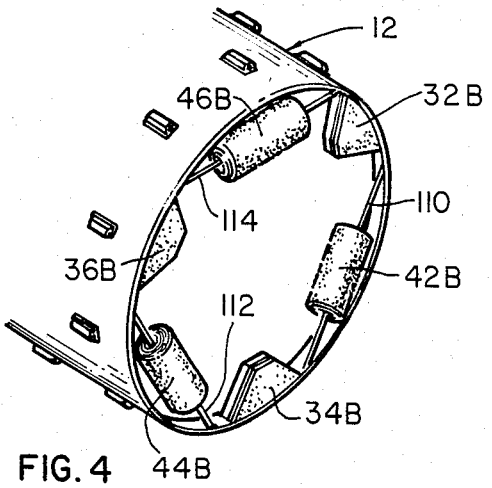
FIG. 4 is a perspective view of another embodiment of a drum mounted baffle system.

The present invention comprises a baffling assembly 30 which is used to alter the sound produced by a drum 10 of a conventional construction having a tubular shell 12 with a central longitudinal drum axis xx which terminates in a circular first end 14 and a circular second end 16. A batter head 18 which is struck by a person playing the drum is mounted on at least one end 14 of the drum shell 12. In some drums, such as marching type drums, a second batter head 19 is mounted on the other drum shell end 16 allowing the drum to be struck on both sides. Although the baffling assembly 30 described for most embodiments herein will be explained as being used in association with a single batter head 18 it will be understood that an identical baffling assembly 31, see FIG. 1, may be provided in association with the opposite batter head 19 to provide the same type baffling effect in association therewith. The batter head 18 comprises a generally radially extending surface 20 which is struck by a person playing the drum and an axially and circumferentially extending rim portion 22 which enables the batter head to be mounted on the drum shell end 14 as by a conventional rim 24 and rim fasteners 26 which are in turn attached to anchors 28 provided on the outer periphery of the drum shell 12.

In general, the baffling assembly of the present invention comprises a plurality of fixed baffles 32, 34, 36 which engage the inside surface of the radially extending portion 20 of the batter head 18 at areas near the periphery of the batter head and which tend to dampen vibrations in the drum head to shorten the vibration period of the drum head. The baffle assembly 30 also comprises floating baffles 42, 44, 46 mounted on a floating baffle frame 48 which remains relatively immobile in a radial direction but which is free to translate with the vibration of the batter head 18 in an axial direction parallel the drum central longitudinal axis xx. The floating baffles also engage the inner surface of the radially extending portion 20 of the batter head 18. The floating baffles are urged into contact with the batter head 18 by a resilient suspension system 60 which enables the floating baffles to move with the batter head 18 as it vibrates. The floating baffles tend to deepen the sound of the drum to provide a rich tone, as opposed to purely shortening the vibration dampening period, due to the fact that the mass of the floating baffles move with the batter head 18 as opposed to merely resisting its vibration through the application of tension thereto. The floating baffles 42, 44, 46 may be construction from a variety of materials, preferably of a sound absorbent variety, such as felt as illustrated in FIG. 1 or plastic foam material such as illustrated in FIG. 2.

Having thus described the invention in general, specific structure of different embodiments of the invention will now be described in detail. As illustrated in FIG. 1, the baffling assembly 30 of the present invention may comprise a first baffle means including fixed baffles 32, 34, 36 mounted about the periphery of a hoop 38 which is in turn fixedly secured to the inner wall of the drum at 39 immediately adjacent to the end 14. The use of a hoop in this manner allows the baffling assembly 30 to be provided in a modular form which may be quickly inserted or removed from a drum shell by conventional attachment means such as bolts, screws, clamps or the like. In another mounting arrangement as illustrated in FIG. 4, the fixed baffles 32, 34, 36 are mounted to the drum shell 12 directly without the use of an intermediate hoop 38.

A second baffle means is provided by floating baffles 42, 44, 46 mounted on a floating baffle frame 48 having a central connector portion 50 and a plurality of elongate frame members 52, 54, 56 radiating therefrom and supporting each of the floating baffles 42, 44, 46. A floating baffle suspension means is provided as by resilient bands 60 which may be rubber and which are supported in the embodiment illustrated in FIGS. 1 and 3 by the fixed baffles 32, 34, 36. The bands 60 may engage the frame members at both the outer terminal ends thereof and also at an intermediate position inward of the associated floating baffle to provide a stable and yet resilient suspension system. The floating baffles 42, 44, 46 themselves are of sufficient diameter to be urged into firm touching engagement with the lower surface of the batter head 18 by the resiliency of the band means 60 which are continuously under tension. It is generally desirable to provide the floating baffles 42 with sufficient surface area to engage on the order of 1 to 3 square inches of the batter head surface area to provide the desired tone altering effects. To this end, when spherical floating baffles are used, such as illustrated by FIG. 2, a portion of the sphere is flattened to provide an enlarged surface engaging area against the batter head. The floating baffles may be axially translatable along the associated longitudinal frame members 52, 54, 56 but are preferably positioned at stationary locations at points outward of mid-radius of the batter head and yet a few inches inward of the drum rim. It has been found that this location in most situations provides a desirable tonal quality.

As illustrated in FIG. 3, the fixed baffle may comprise a radially inwardly extending base plate 70 fixedly secured to the drum shell or, in the embodiment illustrated in FIG. 3, to hoop 38 by conventional attachment means such as high strength epoxy and/or bracket means 80 extending upwardly from the base plate 70 and fixedly secured to the hoop 38 as by screws 82. The bracket 80 may also comprise loop devices 84 thereon to receive and hold the resilient bands 60 used to resiliently support the floating baffle subassembly. Upwardly projecting, triangular-shaped posts 86 may be provided within the angle formed by each of the bands 60 and may be covered with a felt wrap 90 to dampen vibrations in an associated touchingly engaged band 60. Each fixed baffle also comprises an upper body portion 92 having a flat radially extending shape of substantially the same configuration as the lower plate 70 and having downwardly projecting legs 94, 96, 98 which are fixedly attached as by epoxy or other conventional attachment means to the lower base plate 70 and which define leg openings 100 therein enabling the bands 60 to extend outwardly from the fixed baffle. A felt covering pad 102 is provided on the upper surface of the fixed baffle upper body 92 and touchingly contacts the lower surface of the batter head 18 to dampen vibration therein.

Another embodiment of a baffle assembly is illustrated in FIG. 4. In this embodiment, the fixed baffles 32*b*, 34*b*, 36*b* may be identical to those illustrated in FIGS. 1 and 3. However, the floating baffles 42*b*, 44*b*, 46*b* are each mounted on a single linearly extending resilient band 110 which may be affixed at terminal ends thereof to portions of the drum shell inner wall adjacent to associated fixed baffles or, alternatively, to the fixed baffles themselves (not shown).

Figure 5:
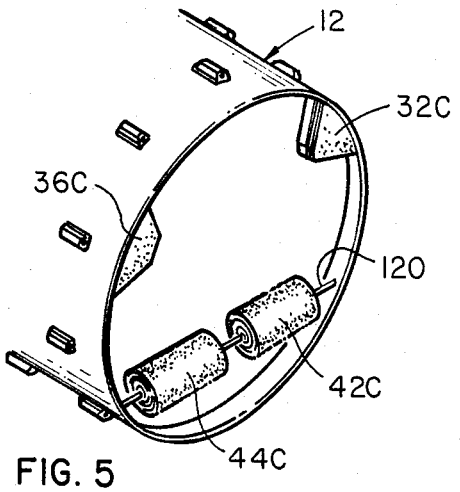
FIG. 5 is a perspective view of another embodiment of a drum mounted baffle assembly.

In the embodiment illustrated in FIG. 5, only two fixed baffles 32*c*, 36*c* are provided and a floating baffle assembly is positioned in the portion of the drum frame symmetrically opposite the fixed baffles. The floating baffle assembly in this embodiment comprises a single resilient band 120 fixedly secured to the drum casing and supporting two floating baffles 42*c*, 44*c*.

Figure 6:
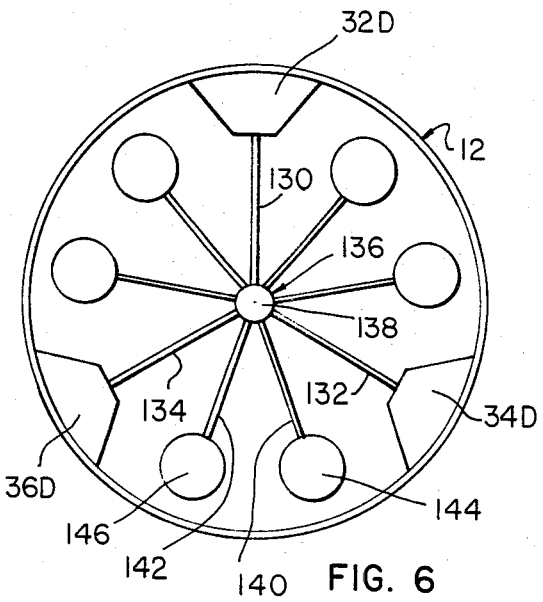
FIG. 6 is an end view of another embodiment of a drum mounted baffle assembly.

In the embodiment illustrated in FIG. 6, three fixed baffles 32*d*, 34*d*, 36*d* are provided which support a set of radially inwardly extending resilient band members 130, 132, 134 which in turn support floating baffle frame 136 at a central point 138 thereon. The floating baffle frame 136 comprises a plurality of radially extending frame members 140, 142, etc. each supporting a floating baffle 144, 146 etc. in a symmetrical arrangement about the central point 138.

Figure 7:
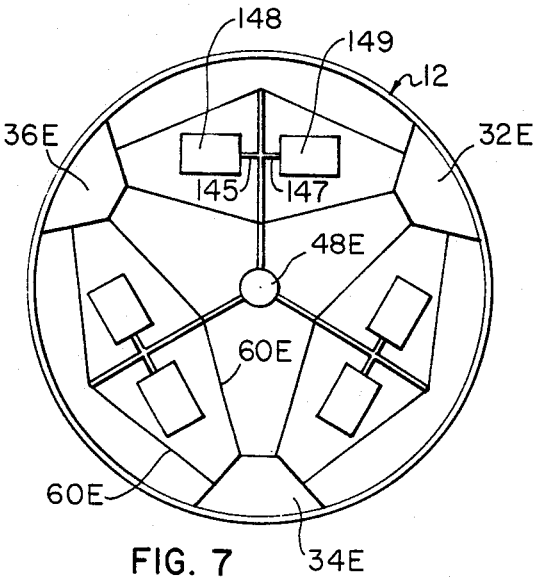
FIG. 7 is an end view of another embodiment of a drum mounted baffle assembly.

In the embodiment illustrated in FIG. 7, the fixed baffle arrangement may be identical to that of FIG. 1 and the floating baffle frame 48*e* may be of essentially identical construction and identically supported as the floating baffle frame of FIG. 1. However, in this embodiment, a pair of floating baffles 148, 149, etc. are mounted on frame portions 145, 147 projecting perpendicularly to each radially projecting frame member 48*e*, etc.

Figure 8:
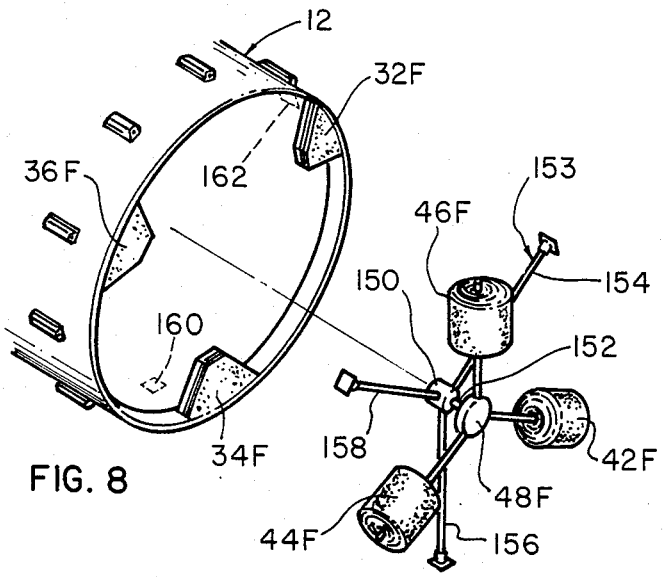
FIG. 8 is an exploded perspective view of another embodiment of a drum mounted baffle assembly.

As illustrated by FIG. 8, the floating baffle frame may also be supported by a plunger member 152 extending axially along the central longitudinal axis of the drum and received within a plunger base 150 containing a spring or other resilient biasing means which tends to urge the plunger and thus the floating baffle frame 48*f* and associated floating baffles 42*f*, 44*f*, 46*f* against the associated batter head (not shown). The plunger assembly is fixed at a central position within the drum head by a plunger support frame comprising for example three radially extending arms 154, 156, 158 which are fixedly secured to the inner wall of the drum shell 12 at a position 160, 162, etc. whereby the floating baffle heads 42*f*, 44*f*, 46*f* are urged against the batter head.

It is contemplated that the inventive concepts herein described may be variously otherwise embodied and it is intended that the appended claims be construed to include alternative embodiments of the invention except insofar as limited by the prior art.

What is claimed is:

1. A baffling system for altering the sound produced by a drum of the type having a tubular drum shell with a central longitudinal drum axis and at least one batter head attached at one end of the drum shell comprising:

first baffle means for dampening vibrations in the drum batter head mounted in fixed relationship with the inner wall of the drum shell and contacting an inner peripheral surface portion of the drum batter head;

second baffle means for deepening the drum tone positioned in radially inwardly spaced relationship from the drum shell inner wall and spaced radially outwardly from the drum central longitudinal axis in contacting relationship with an inner surface of the drum batter head; and second baffle suspension means for resiliently biasing said second baffle means against the batter head inner surface and for maintaining said second baffle means in radially fixed axially displaceable relationship relative said drum shell whereby said second baffle means makes substantially continuous contact with said drum head during vibrating and non-vibrating states of said drum head.

2. The invention of claim 1 wherein said first baffle means comprises:

first baffle rigid support means secured to the drum shell; and first baffle pliable means operably mounted on said rigid support means in contacting relationship with the drum batter head.

3. The invention of claim 2 wherein said first baffle rigid support means comprise a plurality of radially inwardly projecting, circumferentially symmetrically spaced members.

4. The invention of claim 3 wherein said first baffle pliable means comprises felt.

5. The invention of claim 1 wherein said second baffle means comprises:

a plurality of second baffle pliable body means positioned in contacting engagement with the batter head; and rigid frame means for supporting said plurality of second baffle pliable body means.

6. The invention of claim 5 wherein said second baffle rigid frame means comprise a plurality of elongate frame members.

7. The invention of claim 6 wherein said plurality of elongate frame members project radially from a central connection point.

8. The invention of claim 7 wherein said second baffle pliable body means comprise a separate pliable body unit associated with each said radially projecting frame member.

9. The invention of claim 8 wherein at least one said pliable body unit comprises a semi-deformable foam material.

10. The invention of claim 8 wherein at least one said pliable body unit comprises felt material.

11. The invention of claim 8 wherein said pliable body units are symmetrically positioned relative said frame central connection point.

12. The invention of claim 5 wherein said second baffle suspension means comprises resilient means operably associated with said second baffle rigid frame means for urging said second baffle pliable body means against said batter head.

13. The invention of claim 12 wherein said resilient means comprises a plurality of resilient band means affixed to said second baffle rigid frame means.

14. The invention of claim 13 wherein said resilient band means are supported proximate a peripheral portion of the drum batter head.

15. The invention of claim 14 wherein said resilient band means are supported by said first baffle means.

16. The invention of claim 12 wherein said resilient means comprises plunger means supported by radially projecting plunger support arms fixedly mounted on an inner surface of the drum shell.

17. The invention of claim 16 wherein said plunger means is operably attached to a central portion of said second biasing means rigid frame means.

18. The invention of claims 1, 5 or 12 wherein said first and second baffle means and said suspension means comprise a modular unit mounted within a hoop which is operably securable to the inner wall of the drum shell.

* * * * *